US010100634B2

(12) United States Patent
Ganguly et al.

(10) Patent No.: US 10,100,634 B2
(45) Date of Patent: Oct. 16, 2018

(54) DEVICES AND METHODS TO COMMUNICATE INFORMATION FROM BELOW A SURFACE CEMENT PLUG IN A PLUGGED OR ABANDONED WELL

(71) Applicant: Baker Hughes Incorporated, Houston, TX (US)

(72) Inventors: Partha Ganguly, Sugar Land, TX (US); Sushant M. Dutta, Houston, TX (US); Douglas J. Lehr, The Woodlands, TX (US); Bennett Richard, Kingwood, TX (US); Michael H. Johnson, Katy, TX (US); John D. Macpherson, Spring, TX (US)

(73) Assignee: BAKER HUGHES, A GE COMPANY, LLC

( * ) Notice: Subject to any disclaimer, the term of this patent is extended or adjusted under 35 U.S.C. 154(b) by 343 days.

(21) Appl. No.: 14/858,236

(22) Filed: Sep. 18, 2015

(65) Prior Publication Data

US 2017/0081956 A1 Mar. 23, 2017

(51) Int. Cl.

| | |
|---|---|
| ***E21B 47/12*** | (2012.01) |
| ***E21B 47/00*** | (2012.01) |
| ***E21B 33/134*** | (2006.01) |
| ***E21B 33/13*** | (2006.01) |
| ***E21B 47/01*** | (2012.01) |

(52) U.S. Cl.

CPC ..... *E21B 47/122* (2013.01); *E21B 33/13* (2013.01); *E21B 33/134* (2013.01); *E21B 47/0005* (2013.01); *E21B 47/01* (2013.01); *E21B 47/12* (2013.01); *E21B 47/00* (2013.01)

(58) Field of Classification Search

CPC .... E21B 47/122; E21B 47/12; E21B 47/0005; E21B 33/134

See application file for complete search history.

(56) References Cited

U.S. PATENT DOCUMENTS

| | | | | |
|---|---|---|---|---|
| 6,125,933 | A * | 10/2000 | Ross | E21B 34/066 166/250.01 |
| 6,188,222 | B1 * | 2/2001 | Seydoux | E21B 47/12 175/50 |
| 8,616,276 | B2 | 12/2013 | Tips et al. | |
| 8,646,537 | B2 | 2/2014 | Tips et al. | |
| 8,783,369 | B2 | 7/2014 | Rioufol | |
| 2004/0207403 | A1 | 10/2004 | Fanini et al. | |
| 2009/0261986 | A1 | 10/2009 | Mehta et al. | |
| 2012/0073805 | A1 | 3/2012 | Shampine et al. | |
| 2013/0299165 | A1 | 11/2013 | Crow | |

(Continued)

FOREIGN PATENT DOCUMENTS

EP 314654 A1 3/1989

OTHER PUBLICATIONS

D.D.L. Chung, "Electrically conductive cement-based materials," Advances in Cement Research, Oct. 2004, pp. 167-176.

(Continued)

*Primary Examiner* — Nicole Coy
(74) *Attorney, Agent, or Firm* — Shawn Hunter

(57) ABSTRACT

Systems and methods for communicating information relating to at least one wellbore condition across a surface cement plug in a plugged off wellbore. Induction telemetry or galvanic telemetry are used to transmit electromagnetic signals across the axial length of a surface cement plug.

22 Claims, 11 Drawing Sheets

(56) References Cited

U.S. PATENT DOCUMENTS

| | | | |
|---|---|---|---|
| 2014/0182845 | A1 | 7/2014 | Roberson et al. |
| 2014/0251603 | A1 | 9/2014 | Raducanu et al. |
| 2015/0015411 | A1 | 1/2015 | Johnson |

OTHER PUBLICATIONS

Champion et al., "Ormen Lange: Delivering Production Optimization and an Improved Reservoir Understanding Using New Cableless Sandface Monitoring System," SPE 145581, 2011, 12 pages.
Al-Nahdi et al., "Deploying a Wireless Downhole Reservoir Testing System Enabling Real-Time Interpretation and Tool Control," SPE 142669, 2011, 11 pages.

* cited by examiner

DEVICES AND METHODS TO COMMUNICATE INFORMATION FROM BELOW A SURFACE CEMENT PLUG IN A PLUGGED OR ABANDONED WELL

BACKGROUND OF THE INVENTION

1. Field of the Invention

The invention relates generally to systems and methods for monitoring conditions within a plugged subterranean wellbore.

2. Description of the Related Art

At the end of the production lifetime of a well, the wellbore is permanently plugged and abandoned. The typical fashion of doing this involves milling away and removing an upper portion of the surface casing (usually about 500 feet worth of casing) and then setting one or more completion plugs in casing below the milled away area. Thereafter, the uncased portion of the wellbore above the completion plugs is filled with cement (a "surface cement plug").

This procedure is usually intended to be a permanent closing off of the wellbore. However, it is often important to obtain information from below the surface cement plug, often on a continuous basis. This information might include pressure, temperature (above or below the surface cement plug) or information about oil and gas migration though the cement. Continuous monitoring of such parameters can help identify potential breach of the plugged and abandoned state. The frequency of such communication may be low. In some cases, communication might only be required if measured parameters exceed a predetermined threshold value.

Some methods for transmitting information from a downhole location have involved the use of conductive casing or tubing for transmission. Those methods are unsuitable for use in most instances where a well is plugged off since there is no casing or tubing which traverses the surface cement plug.

SUMMARY OF THE INVENTION

The invention provides systems and methods for communicating information from within a plugged and/or abandoned wellbore and, in particular, across a surface cement plug which has been emplaced within such a well at or near the surface. Exemplary systems and methods of the present invention employ electromagnetic ("EM") telemetry to transmit information through the surface cement plug and/or through the formation/earth area surrounding the plugged off wellbore. These systems are intended to be installed at the time a wellbore is plugged off. The invention provides devices and methods for transmitting information across a surface cement plug using electromagnetic ("EM") wave signals. In preferred embodiments, the EM wave signals are in the forms of either induced current telemetry or galvanic telemetry.

According to a first described embodiment, induction telemetry is used to transmit information uphole to surface from below the surface cement plug. In accordance with a preferred embodiment, a transmitter coil is located proximate the lower end of the surface cement plug, and a receiver coil is located at surface proximate the upper end of the surface cement plug. The transmitter coil is operably associated with one or more sensors that are configured to detect or monitor particular conditions or parameters within the wellbore below the surface cement plug. In accordance with preferred embodiments, a controller is operably associated with the transmitter coil and causes the transmitter coil to create a time-varying voltage signal which is indicative of the detected parameter or parameters. Current is induced into the receiver coil by the transmitter coil. The induced current can be measured to determine the value of the parameter being communicated.

In accordance with alternative described embodiments, galvanic telemetry is used to transmit information uphole to surface across a surface cement plug. In accordance with one described embodiment, an insulated gap is provided at the lower end of the surface cement plug which separated the surface cement plug from the completion plug and casing below. An electrical potential is applied across the insulated gap causing current to flow upwardly through the surface cement plug. The circuit is completed as current flows back through the earth surrounding the surface cement plug to the casing below the insulated gap. Current traveling through the surface cement plug from the insulated gap to the surface can be measured by electrodes or a dipole antenna at surface. In accordance with a further alternative arrangement the insulated gap is replaced with a toroidal coil which acts as the mechanism to inject current.

In particular embodiments, duplex communication of power and information is provided between the surface and components below the surface cement plug. This two-way communication and power transfer permits information to be sent from the surface to system components located below the surface cement plug. In addition, the two-way communication can allow for charging of downhole power sources from the surface, if desired.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
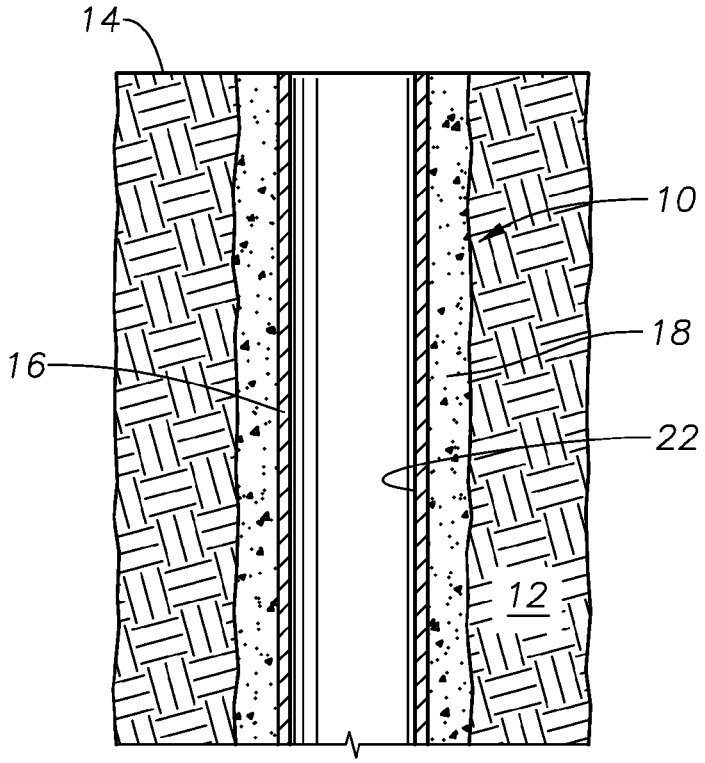
FIG. 1 is a side, cross-sectional view of the upper portion of an exemplary wellbore.

FIG. 1 depicts the upper portion of an exemplary wellbore 10 which has been drilled through the earth 12 from the surface 14. The wellbore 10 has been lined with metallic casing 16 which is radially surrounded by a layer 18 of casing cement.

Figure 2:
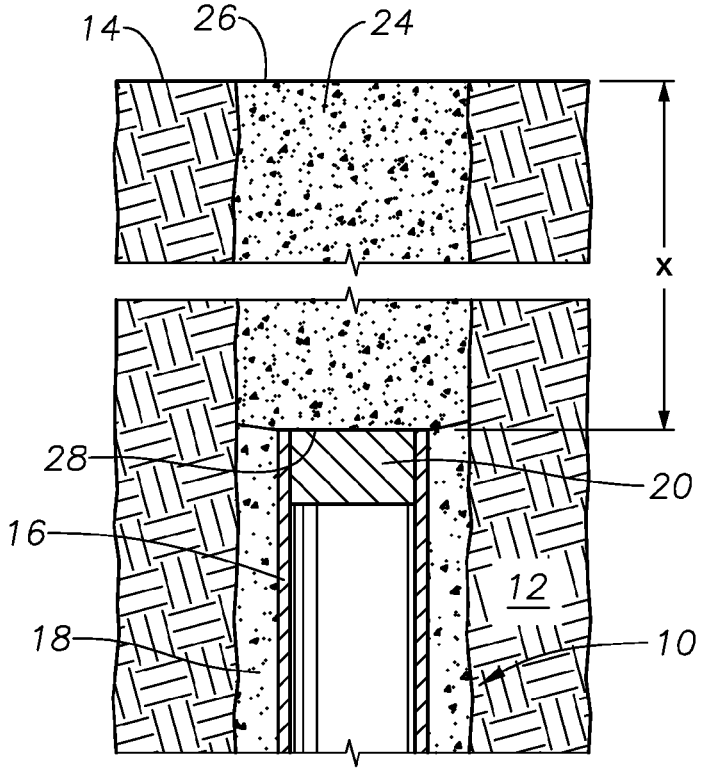
FIG. 2 is a side, cross-sectional view of the wellbore portion shown in FIG. 1, now having been plugged off with a surface cement plug.

FIG. 2 illustrates the upper portion of wellbore 10 now in a plugged off configuration. The upper end of metallic casing 16 has been cut away. Normally, about 500 feet of casing has been removed. The casing cement 18 has also been removed along with the casing 16. A completion plug 20, of a type known in the art, is shown disposed within the casing 16 of the wellbore 10. A surface cement plug 24 has been poured and cured atop the completion plug 20 as well as the casing 16 and casing cement 18. In preferred embodiments, the surface cement plug 24 has an axial length ("x") which extends a distance from the completion plug 20 to a point proximate the surface 14. The surface cement plug 20 has an upper axial end 26 and a lower axial end 28.

Figure 3:
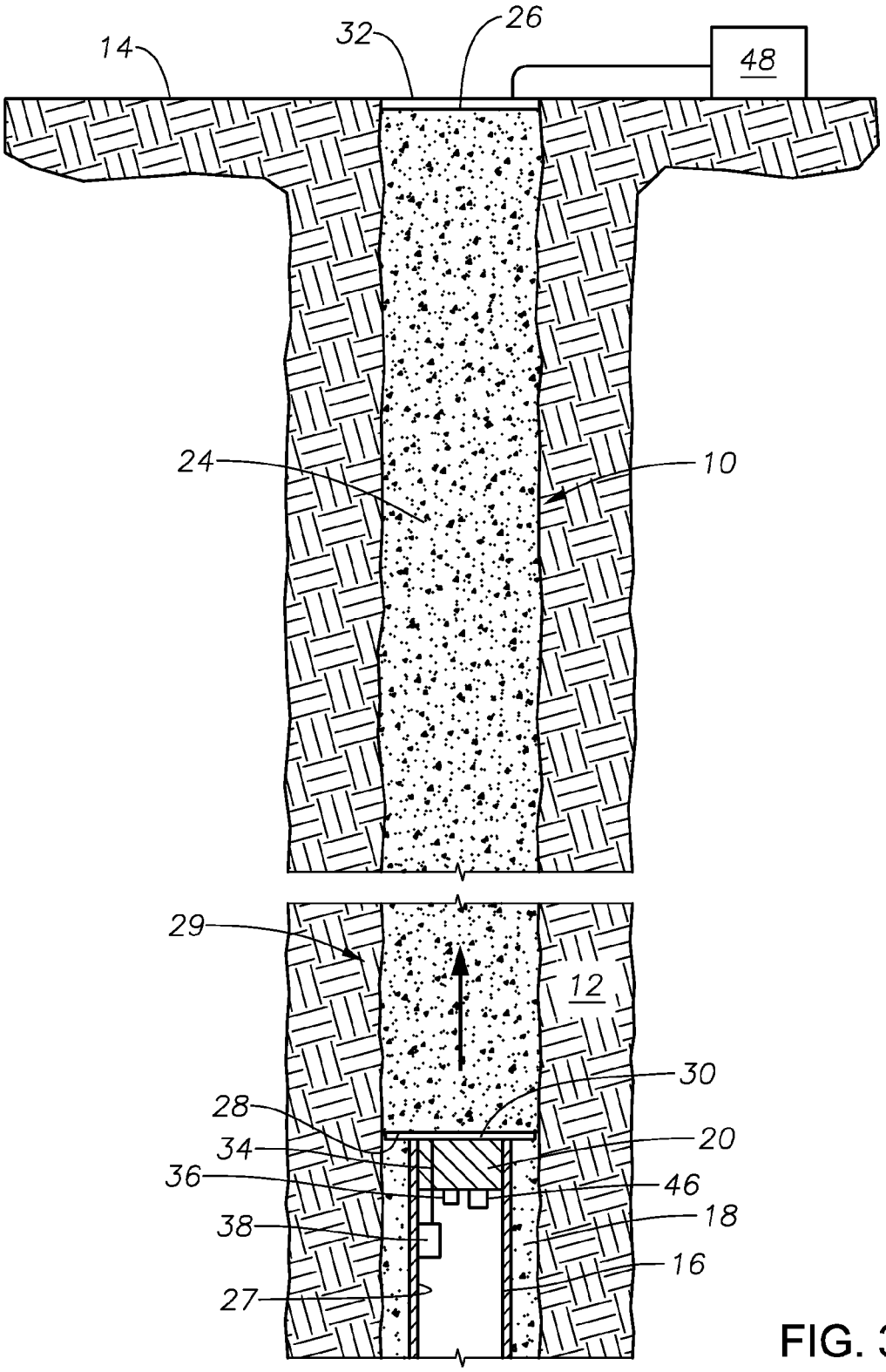
FIG. 3 is a side, cross-sectional view of the wellbore shown in FIG. 2, now illustrating exemplary placement of transmitter and receiver coils and associated components.

FIG. 3 illustrates a first exemplary information transmission system 29 which uses induction telemetry to transmit information from the lower axial end 28 of the surface cement plug 24 to the upper axial end 26 of the surface cement plug 24. An induction telemetry transmitter coil 30 is located within the wellbore 10 proximate the lower axial end 28 of the surface cement plug 24. An induction telemetry receiver coil 32 is located proximate the upper axial end 26 of the surface cement plug 24. The transmitter coil 30 is operably connected via wire 34 with a wellbore condition sensor 36/controller 46. The wellbore condition sensor 36 is capable of detecting or measuring one or more operational conditions within the wellbore 10. Exemplary wellbore operational conditions which might be detected by the wellbore condition sensor 36 include pressure and temperature. Where these parameters are being measured, pressure transducers or thermocouples can be used as the sensor(s) 36. Alternatively, devices such as accelerometers, hydrophones or acoustic sensors can be used with the sensor(s) 36 to detect other wellbore operational conditions including the presence of gas, oil or water via resistivity or conductivity measurement. The presence of $CO_2$ or $H_2S$ might be detected. Cement integrity, flow behind the casing 16 or casing 16 condition, or other parameters or conditions might also be sensed. Wire 34 passes through (or around) the completion plug 20. According to alternative embodiments, the wire 34 may be replaced with a wireless communication link. The wellbore condition sensor 36 is preferably located within the flowbore 27 of the wellbore 10 below the completion plug 20.

Figure 4:
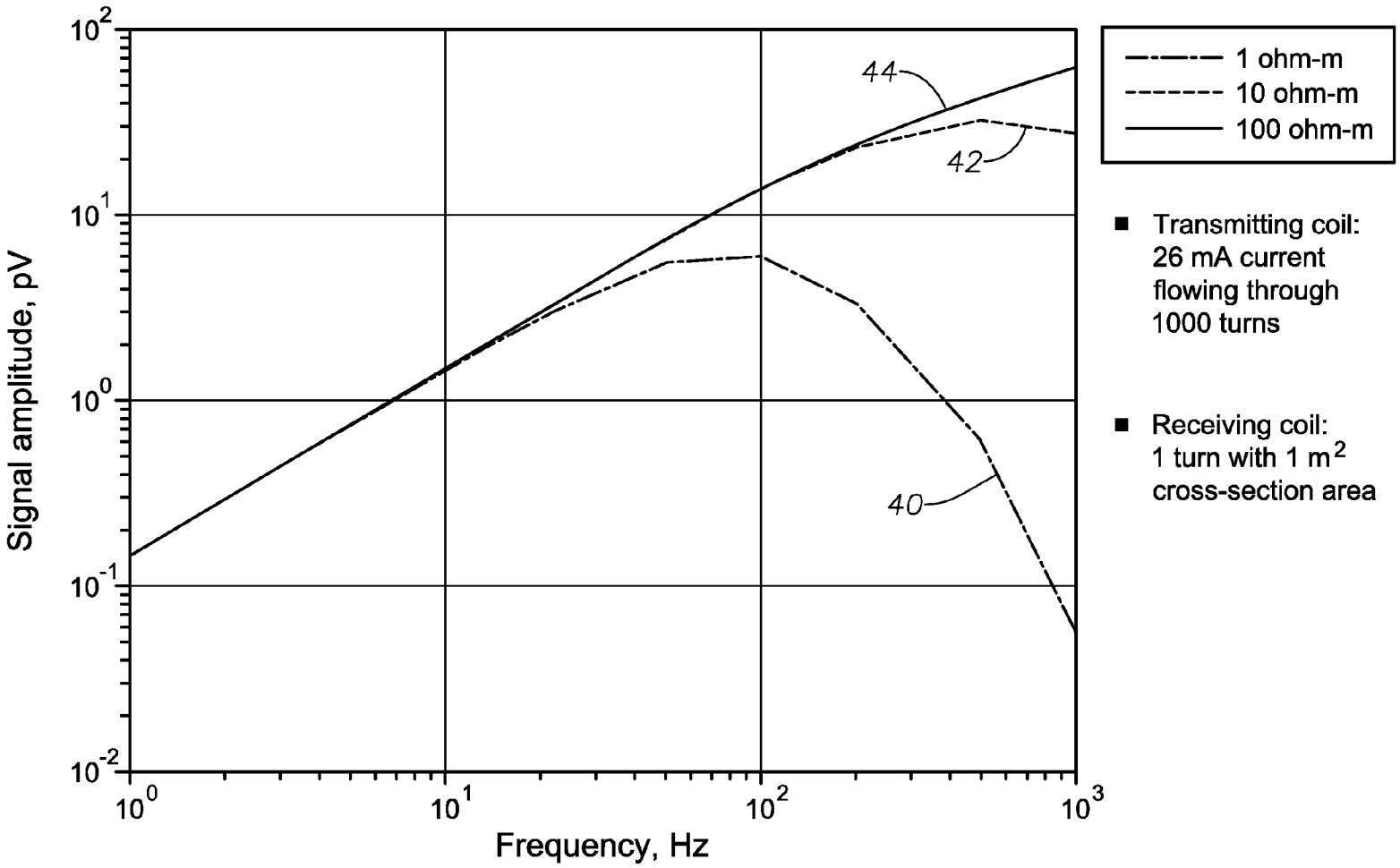
FIG. 4 is a graph depicting signal amplitude versus signal frequency for different formation resistivity.
Figure 4A:
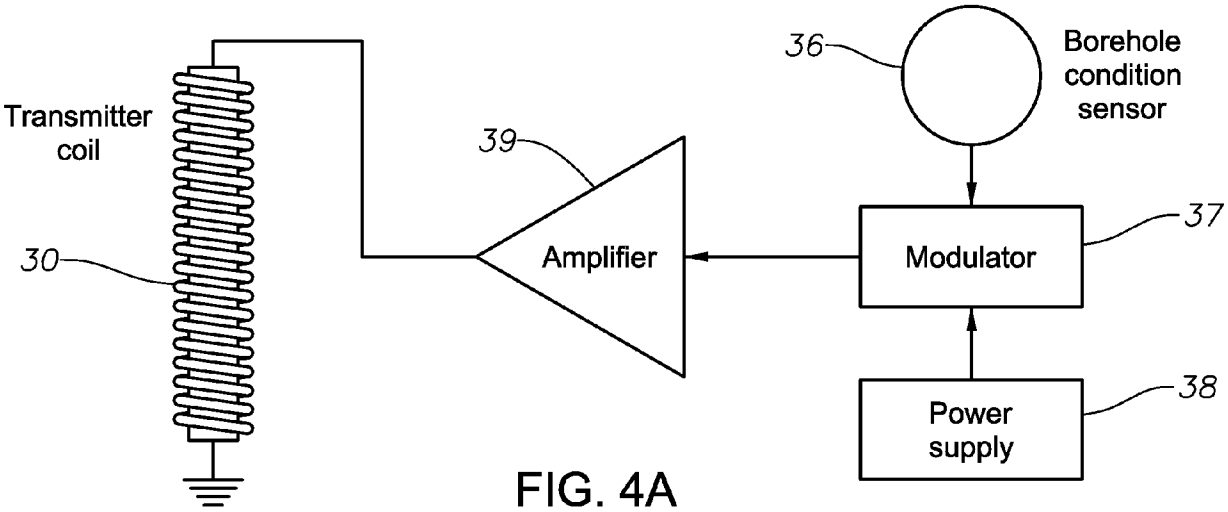
FIG. 4A is a schematic depiction of an exemplary transmitter coil arrangement with associated components.

The induction telemetry transmitter coil 30 is made up of at least one turn of conductive wire. Preferably, there is more than a single turn of conductive wire as a larger number of turns will provide a greater induced voltage to be received by the receiver coil 32. The conductivity of the wire making up the transmitter coil 30 and the number of turns of the conductive wire should be sufficient to generate an induced voltage signal which can be detected by the receiver coil 32. Length of the surface cement plug 24 will largely dictate the amount of power required or desired to be transmitted by the transmitter coil 30 so that it can be received by the receiver coil 32. In operation, current is generated within the transmitter coil 30 by a power source 38. Current is then induced in the receiver coil 32 by the transmitter coil 30. The power source 38 may be a downhole battery, as the inventors have recognized that EM telemetry schemes of the type described herein use very small amounts of power (less than 100 mW) and are typically only needed to operate intermittently. The transmitter coil 30 might be enclosed within a suitable protective casing or housing for protection of the transmitter coil 30 from corrosive chemicals and debris. In certain embodiments, the protective casing or housing might comprise epoxy. FIG. 4A illustrates an exemplary transmitter coil 30 and associated components which might be used with the transmitter coil 30. As shown, a modulator 37 and amplifier 39 are operably associated with the transmitter coil 30 so that information received from the sensor 36 is suitably converted to be transmitted by the transmitter coil 30 as a signal.

Currently preferred frequencies of transmission is 100 Hz and lower. However, an optimal frequency of transmission in any particular application generally depends on the average resistivity of the earth 12 surrounding the wellbore 10 as well as on the depth of the completion plug 20. FIG. 4 illustrates the voltage generated at the receiver coil 32 for a 26 mA current in the transmitter coil 30. Line 40 illustrates signal amplitude (pV) vs. frequency (Hz) for a voltage signal being propagated through an earth formation having a resistivity of 1 ohm-m. Line 42 illustrates signal amplitude vs. frequency for a voltage signal propagated through an earth formation having a resistivity of 10 ohm-m. Line 44 depicts signal amplitude vs. frequency for a voltage signal propagated through an earth formation having a resistivity of 100 ohm-m.

In order to provide a signal which can transmit information, the transmitter current is varied over time by a controller 46. The controller 46 is preferably a programmable logic circuit which is capable of receiving data from the wellbore condition sensor(s) 36 and, in response, selectively energizing the transmitter coil 30 in accordance with a predetermined scheme for encoding the data so that it can be transmitted via electromagnetic induction from the transmitter coil 30 to the receiver coil 32. The controller 46 preferably includes a processor with associated memory. The controller 46 is preferably programmed with suitable programming to enable it to control operation/energization of the transmitter coil 30 so as to generate an electromagnetic induction signal which can be received by the receiver coil 32. Any of a number of suitable signal modulation schemes can be used to encode information within the signal being transmitted from the transmitter coil 30. Suitable modulation schemes include ASK (amplitude-shift keying), FSK (frequency-shift keying), PSK (phase-shift keying) or higher order variants such as QAM (quadrature amplitude modulation). The signal encoding can be continuous or in bursts. In the depicted embodiment, an EM signal indicative of one or more sensed wellbore conditions is transmitted across the axial length (x) of the surface cement plug 24.

Figure 4B:
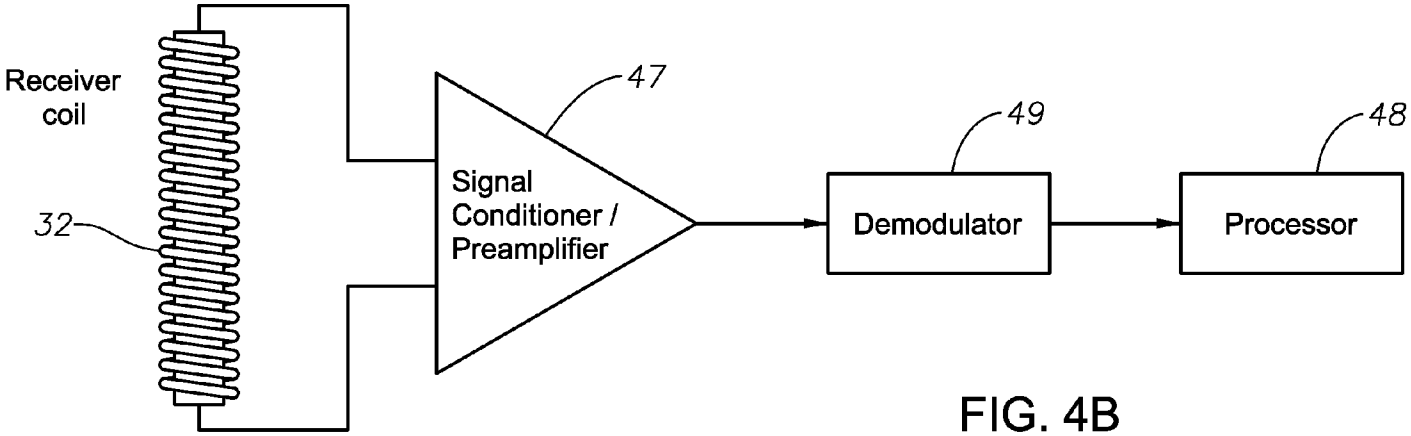
FIG. 4B is a schematic depiction of an exemplary receiver coil arrangement with associated components.

In preferred embodiments, a number of components at surface 14 are operably associated with the receiver coil 32. A processor 48 is operably interconnected with the receiver coil 32 which is capable of receiving the induced current signal from the receiver coil 32 and displaying and/or storing this information. FIG. 4B illustrates an exemplary arrangement wherein a signal conditioner/preamplifier 47 and a demodulator 49 are used to provide a suitable received signal to the processor 48.

In operation, the transmitter coil 30 and receiver coil 32 are emplaced when the wellbore 10 is plugged off. In addition, the power source 38, sensor 36 and controller 46 are emplaced beneath the completion plug 20 while the transmitter coil 30 is located beneath the surface cement plug 24 but above the completion plug 20.

Figure 5:
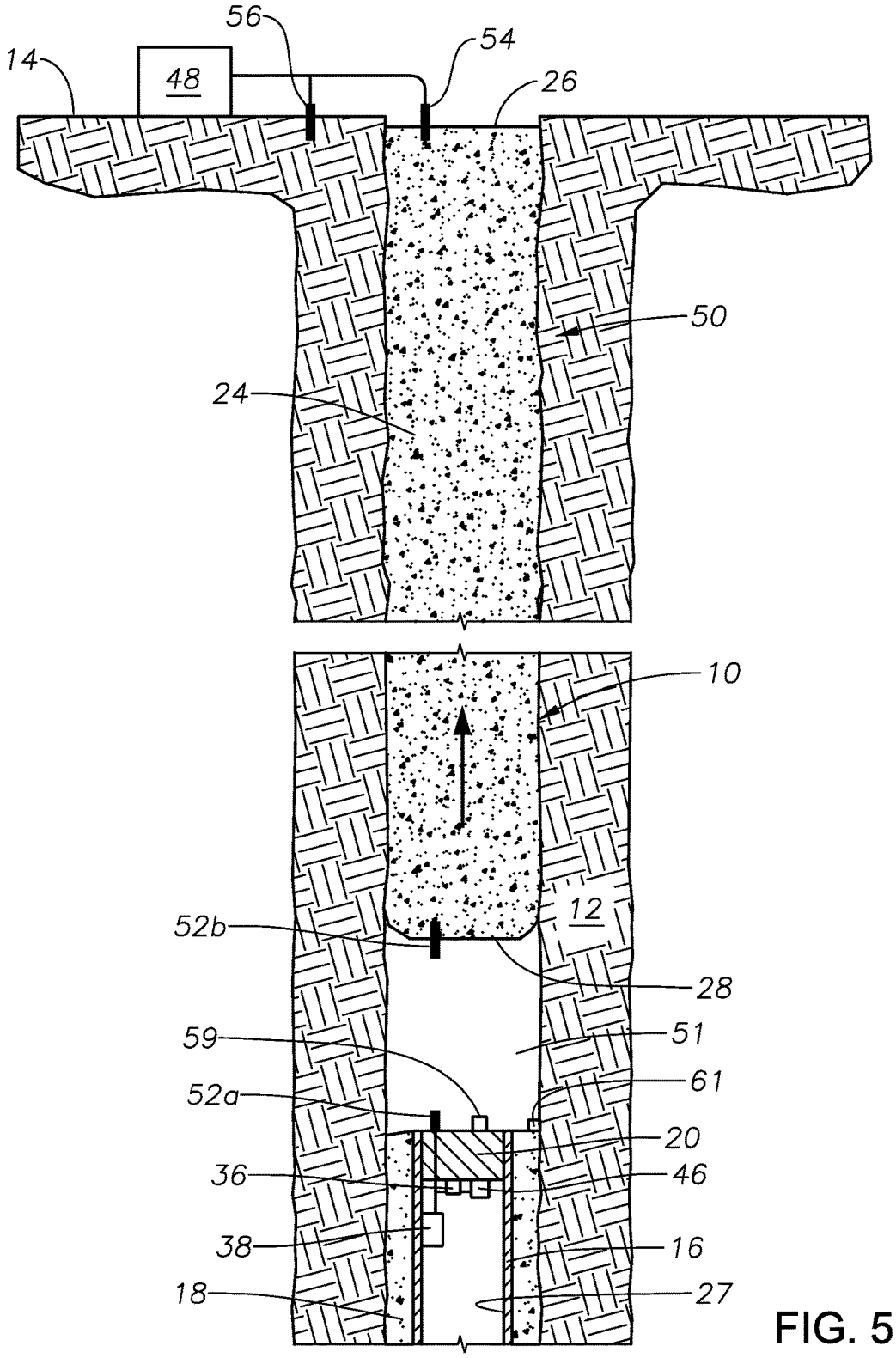
FIG. 5 is a schematic, isometric view of the upper portion of a wellbore illustrating components associated with an alternative information transmission arrangement which utilizes galvanic telemetry.

FIG. 5 illustrates an alternative information transmission system 50 in accordance with the present invention for transmitting EM energy and information across a surface cement plug 24. The uphole information transmission system 50 employs galvanic telemetry to transmit information relating to at least one wellbore condition across the surface cement plug 24. The transmission system 50 includes an insulated gap 51 which separates the surface cement plug 24 above from the completion plug 20 and casing 16 below. The insulated gap 51 may be an air gap. Alternatively, the insulated gap 51 may be formed of elastomer, epoxy or other non-conductive or poorly conductive material. The material making up the insulated gap 51 should be less conductive than the material forming the surface cement plug 24 or the completion plug 20/casing 16. Currently preferred length for an air-type insulated gap is from about 1 meter to about 3 meters. However, smaller or larger lengths can be used so long as they are sufficient to allow generation of current upward through the surface cement plug 24.

Electrodes 52*a*, 52*b* are located at opposite axial ends of the insulated gap 51 with the upper electrode 52*b* being a current injection electrode 52. The lower electrode 52*a* is operably interconnected with the sensor(s) 36, power source 38 and controller 46. An electrical signal representative of the wellbore condition(s) detected by the wellbore condition sensor(s) 36, such as temperature or pressure, is provided by the controller 46 to the current injection electrode(s) 52. The controller 46 is operable to receive data from the sensor(s) 36 and selectively energize the lower electrode 52*a* in accordance with a predetermined scheme for encoding the data (i.e., FSK, PSK, etc. discussed above) so that it can be transmitted via galvanic telemetry from the upper electrode 52*b* toward current receiving electrode 54 at surface 14.

In order to generate current flow, an electrical potential is applied across the insulated gap 51 to cause current to flow through primarily the surface cement plug 24 as well as to some degree through the surrounding earth 12. The electrical circuit supporting current flow is completed by current flow back through the earth 12 to the casing 16. The electrical conductivity of the cement making up the surface cement plug 24 is important to effective galvanic telemetry in this instance. Ordinary casing cement has an electrical resistivity of about 3000 ohm-m and can possibly be used for the galvanic telemetry transmission system 50. It is currently preferred, however, that more conductive cement materials (referred to herein as "highly conductive cement" materials) be used. D. D. L. Chung has described conductive cement materials having resistivity on the order of 0.03 ohm-m. See Chung, D. D. L., "Electrically Conductive Cement-Based Materials," Advances in Cement Research 16, No. 4. (2004). Cements or cement admixes which contain conductive fillers, such as Chung describes, and therefore have lower resistivity than conventional cements are preferred for formation of the surface cement plug 24. It is also noted that there are commercially available cement admixtures which would be suitable for and preferred for use in the transmission system 50 of the present invention. One such commercially available cement admixture is Conducrete® conductive cement which is marketed by SAE Inc. of Humble, Tex. It is further noted that the use of conductive cement might also be used for the surface cement plug 24 in the instance of inductive telemetry described earlier with respect to FIG. 3.

A pair of galvanic telemetry current receiving electrodes 54, 56 are located at surface 14 and may be in the form of metal rods. The first galvanic telemetry receiving electrode 54 is preferably disposed within the surface cement plug 24 or in the earth 12 very proximate the plug 24 in order to detect electrical current transmitted through the surface cement plug 24 by the current injection electrode 52*b*. The second receiving electrode 56 is disposed within the earth 12 at a point that is sufficiently distant from the wellbore 10 so that it will not detect current that is transmitted through the surface cement plug 24 by the current injection electrode 52*b*. A distance of about 3 meters is typically sufficient. However, the distance between the current receiving electrodes 54, 56 might be as much as 300 meters, particularly if dealing with very low signal levels and/or challenging geology since the return path is through the earth 12 at infinity. Processor 48 is operably interconnected with both the first and second receiving electrodes 54, 56 and is capable of comparing the electromagnetic signals detected by each of them. In addition, the processor 48 is preferably capable of display and/or storage of this information.

Figure 6:
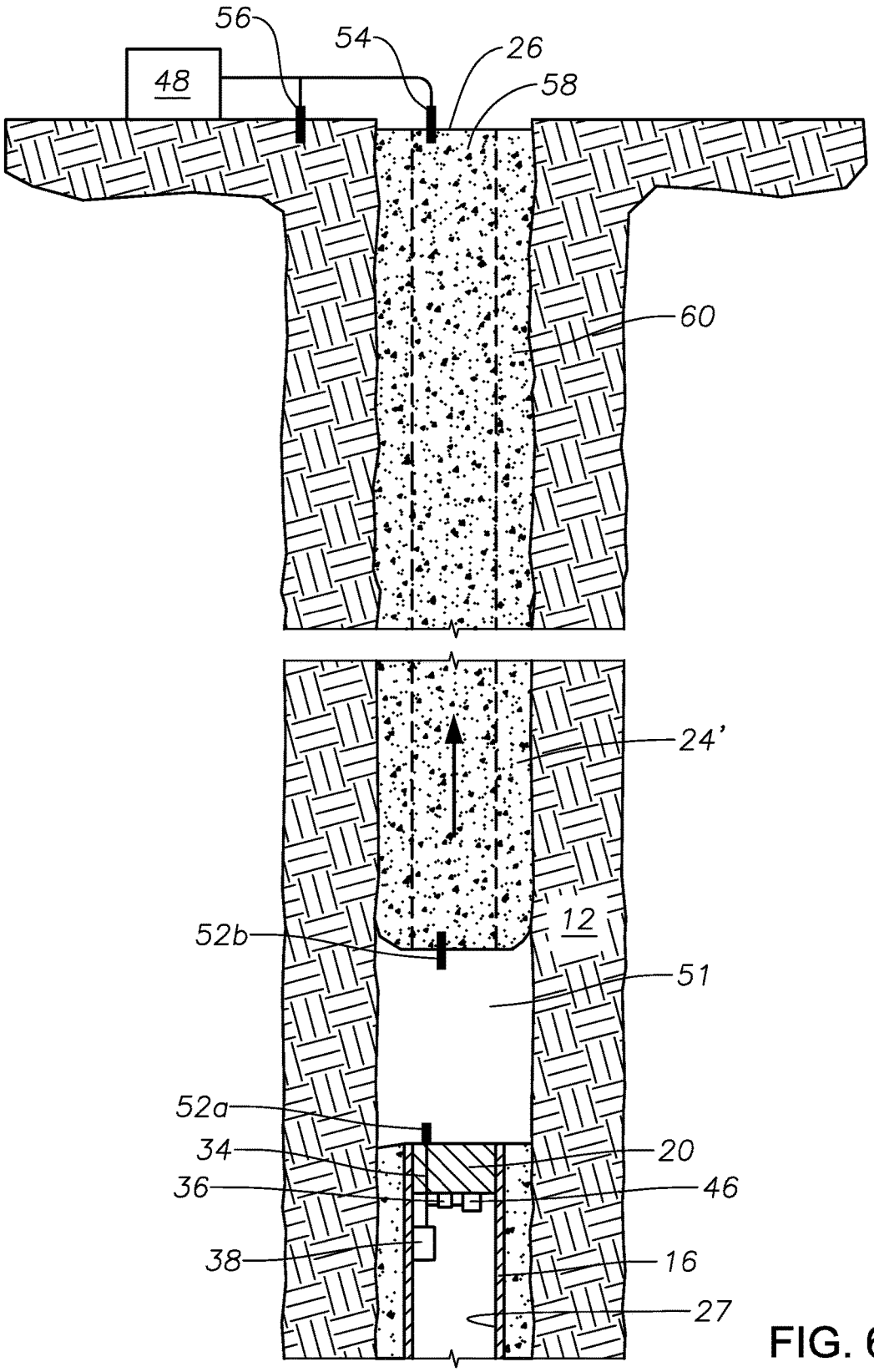
FIG. 6 is a side, cross-sectional view illustrating an alternative galvanic telemetry information transmission system wherein an outer radial layer of the surface cement plug is made up of a highly conductive cement material.

In accordance with certain embodiments, such as that shown in FIG. 5, the entire surface cement plug 24 is uniformly made up of a single cement composition. FIG. 6 illustrates an alternative embodiment wherein the surface cement plug 24' is made up of a composite configuration having central portion 58 formed of a first cement material and an outer radial layer 60 which is formed of a second cement material which has a lower resistivity (greater conductivity) than the material making up the central portion 58.

FIG. 5 also illustrates optional additional exterior sensors 59, 61 (i.e., they are exterior of the wellbore casing 16) which are located above the completion plug 20 and below the surface cement plug 24. The exterior sensors 59, 61 preferably detect the presence of oil, water or gas within the gap between the completion plug 20 and the surface cement plug 24, which might indicate leakage from the wellbore 10 across the completion plug 20. The exterior sensors 59, 61 are operably interconnected with the controller 46 so that information sensed by the exterior sensors 59, 61 is provided to the controller 46 and encoded for transmission across the surface cement plug 24. It is noted that, while exterior sensors 59, 61 are shown with respect to a galvanic telemetry communication system 50, they could also be used with an induction telemetry communication system such as the one described earlier.

It is also noted that one might use other composite configurations wherein one portion of the surface cement plug forms a pathway through the axial length of the surface cement plug and has a greater conductivity and lower resistivity than other portions of the surface cement plug. For example, one or more shafts formed of a highly conductive cement might be formed within the surface cement plug, these shafts providing a conductive path across the surface cement plug.

Figure 7:
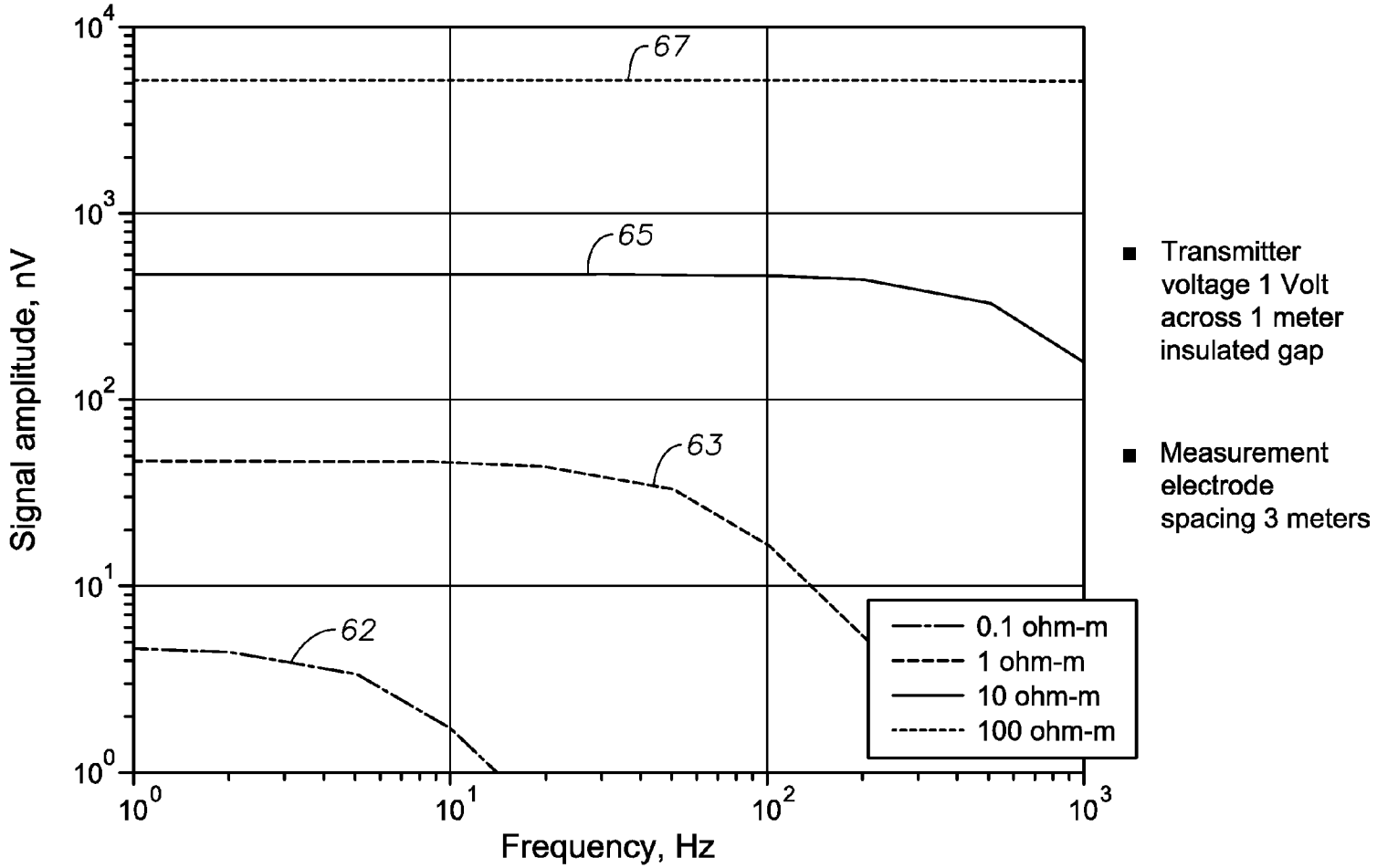
FIG. 7 is a graph depicting signal amplitude vs. signal frequency for different formation resistivity for an exemplary galvanic telemetry communication system in accordance with the present invention.

FIG. 7 is a graph depicting signal amplitude versus signal frequency for different formation resistivity for an exemplary galvanic telemetry system. For the illustrative system, the insulated gap 51 is 1 meter in axial length, and the potential difference being generated across the insulated gap 51 is 1 volt. Line 62 illustrates signal amplitude (nV) vs.

frequency (Hz) for a voltage signal being measured through an earth formation having a resistivity of 0.1 ohm-m. Line 63 illustrates signal amplitude vs. frequency for a voltage signal measured through an earth formation having a resistivity of 1 ohm-m. Line 65 illustrates signal amplitude vs. frequency for a voltage signal measured through an earth formation having a resistivity of 10 ohm-m. Line 67 illustrates signal amplitude vs. frequency for a voltage signal measured through an earth formation having a resistivity of 100 ohm-m. FIG. 7 illustrates that, when the earth 12 formation is more resistive, it is easier to measure signal at surface 14. It should also be appreciated that the signal strength using galvanic telemetry is significantly higher than the signal using induction telemetry. The frequency of the injection current signal is preferably on the order of 10-100 Hz, although other frequencies might also be used. An injection voltage of 1 volt through a conductive surface cement plug 24 can yield a voltage at surface 14 on the order of 50 nV and above.

Figure 8:
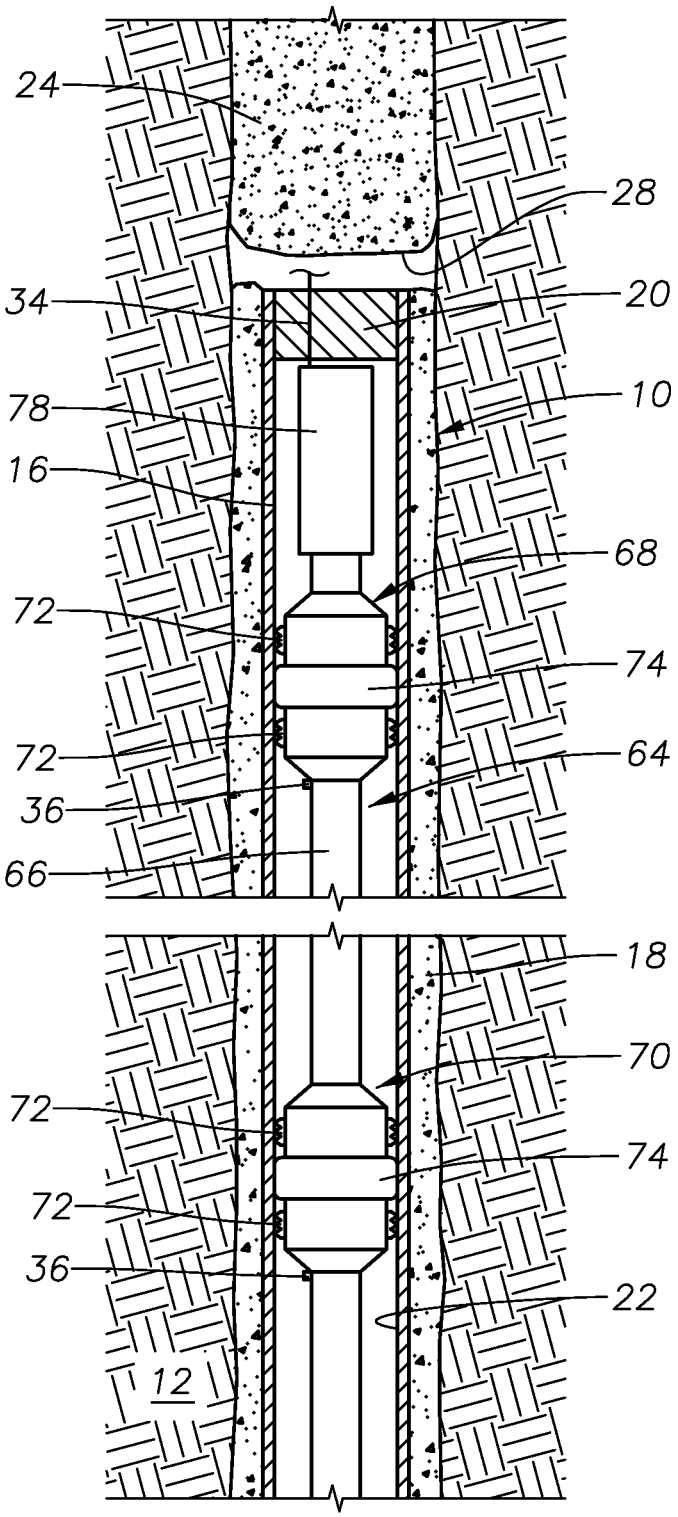
FIG. 8 is a side, cross-sectional view of portions of an exemplary information transmission system below a completion plug in a wellbore.
Figure 9:
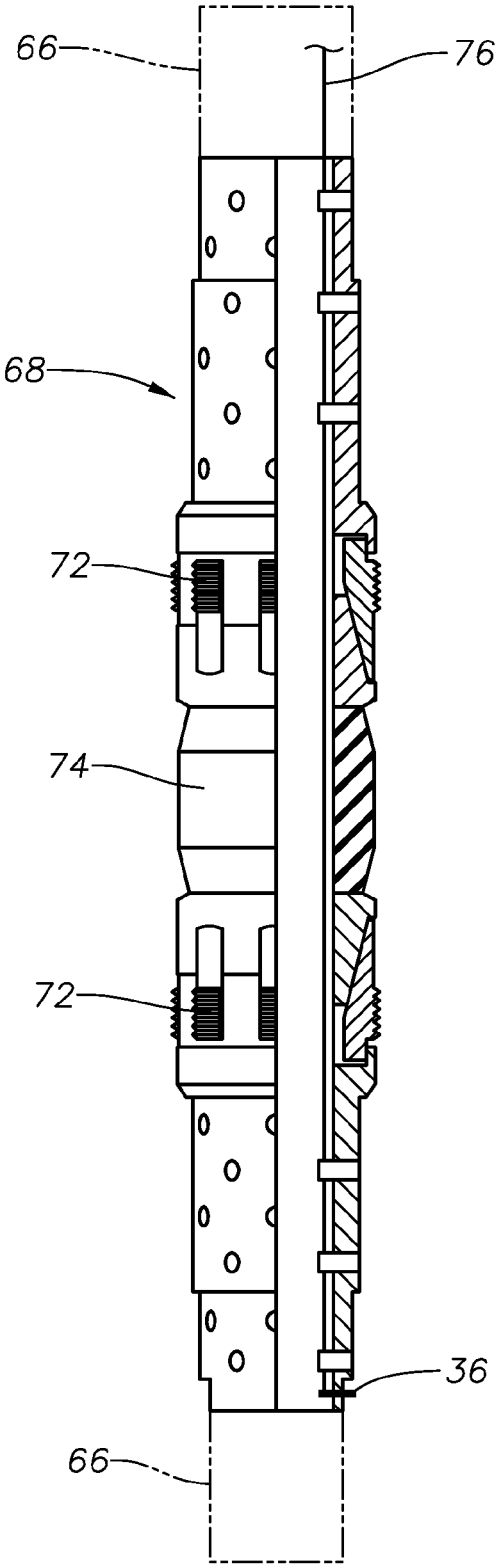
FIG. 9 is a further side, cross-sectional view of portions of an exemplary information transmission system below a completion plug in a wellbore.

While FIGS. 3, 5 and 6 depict sensor(s) 36, power source 38 and controller 46 schematically, FIGS. 8 and 9 illustrate an exemplary construction for practical placement of wellbore condition sensors within the wellbore 10 below the completion plug 20. The configuration shown in FIG. 6 illustrates, particularly, pressure sensors. However, it should be understood that sensors which detect temperature or other wellbore conditions might also be used. In the depicted embodiment, sensors 36 are incorporated into a tool string 64 that is hung within the wellbore 10 below the completion plug 20. The tool string 64 includes a central mandrel 66 and a plurality of plugs 68, 70 that are located at spaced intervals along the mandrel 66. Although only two plugs 68, 70 are depicted, those of skill in the art will understand that there may be more or fewer than two. According to currently preferred embodiments, the plugs 68, 70 and others are separated by about 30 foot intervals so that pressures at various depths within the wellbore 10 can be monitored. The plugs 68, 70 are of a type known in the art and, in the depicted embodiment, include setting slips 72 and a compression-set packer element 74 which are set against the interior surface of the casing 16 to secure the tool string 64 within the wellbore 10. Preferably, the sensors 36 are each incorporated into a plug 68 or 70. FIG. 9 illustrates a single plug 68 wherein the sensor 36 is located on the bottom-hole side of the plug 68. One or more signal wires 76 extend through the plug 68 and along the mandrel 66 from the sensor 36 uphole to a data sub 78. The data sub 78 contains the controller 46.

Figure 10:
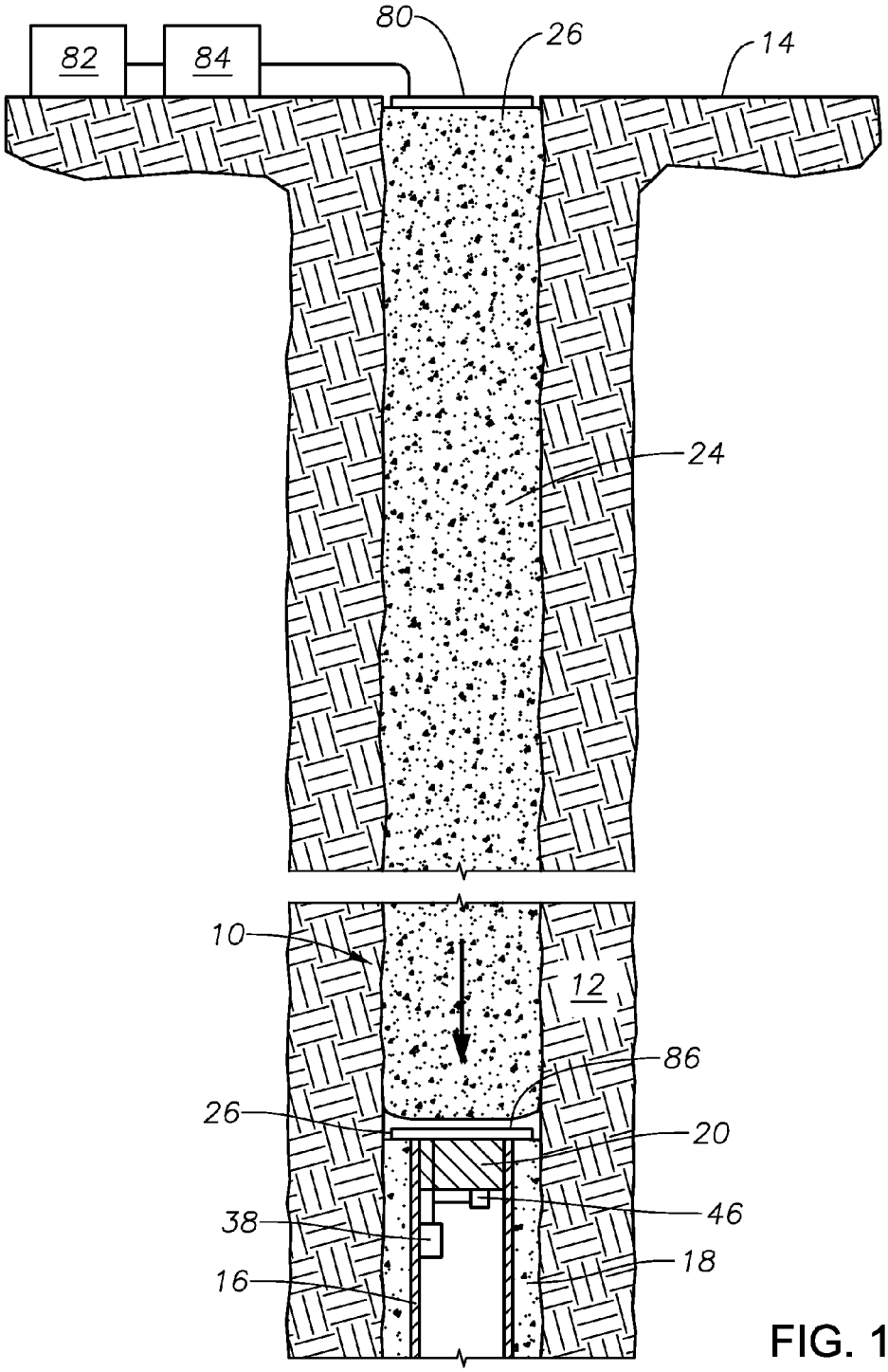
FIG. 10 is a side, cross-sectional view of an exemplary information transmission system which supports duplex transmission or information and/or power from surface.

FIG. 10 illustrates a system for duplex (two-way) communication between the surface 14 and components below the surface cement plug 24. For clarity, the features used to transmit information from downhole upwardly across the surface cement plug 24 are not shown in FIG. 10, although those of skill in the art will understand that they are present given previous description of them above. It is noted that duplex communication may be used with either an inductive telemetry system 29 or a galvanic telemetry system 50. An EM signal transmitter 80 is located at surface 14. In the depicted embodiment, the EM signal transmitter 80 is a transmitter coil which may be of the same construction as the transmitter coil 30 described previously. The signal transmitter 80 is operably interconnected with a controller 82 and power source 84 which can energize the signal transmitter 80 in order to create an encoded EM information signal which will travel downwardly through the surface cement plug 24 to a signal receiver 86. The signal receiver 86 is operably associated with the controller 46 for the uphole information transmission system 29 or 50. In the depicted embodiment, the signal receiver 86 is a receiver coil which may be constructed in the same manner as the receiver coil 32 described previously.

Communication schemes such as FSK, PSK, ASK and others may be used to encode information into the signal that is transmitted from the signal transmitter 80 to the signal receiver 86. Duplex communication allows communication of commands from surface 14 to the uphole information transmission systems 29 or 50. Duplex communication might be utilized as a power saving measure. In this instance, the controller 46 is programmed to be inactive, or sleep, until a command is sent from signal transmitter 80 to the signal receiver 86 to cause the controller 46 to "wake up" and become active to cause uphole transmission of EM signals. Duplex communication could also allow transmission of electrical power downhole from the surface 14, which could be used to charge downhole battery 38 so long as the battery 38 is rechargeable and provided with suitable apparatus, as is known in the art, to receive the transmitted EM energy and utilize it for battery charging.

Figure 11:
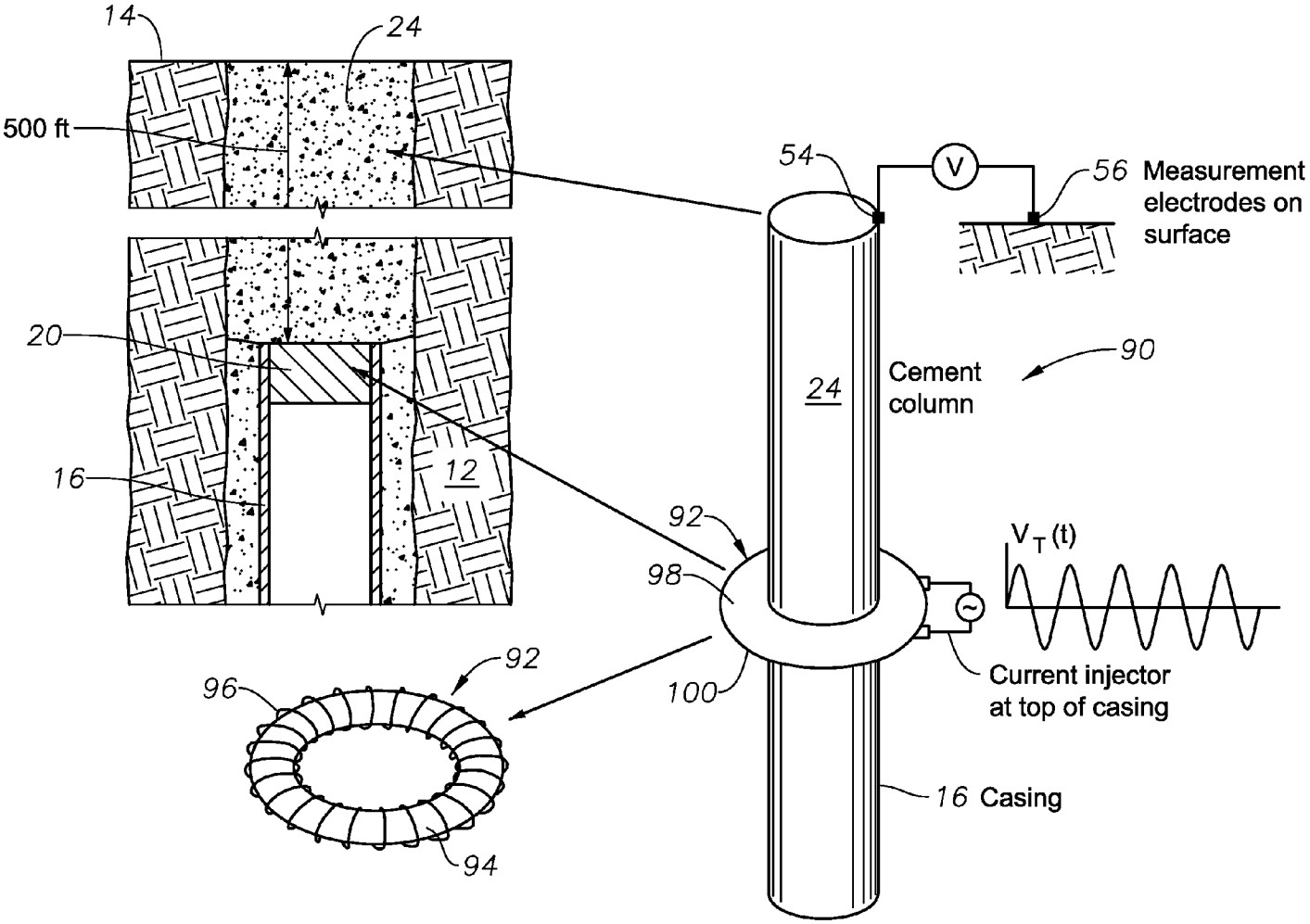
FIG. 11 is a schematic, isometric view of an exemplary galvanic telemetry system which incorporates a toroidal coil.

FIG. 11 illustrates an alternative embodiment for a galvanic telemetry system 90 wherein the current injector at the lower end of the surface cement plug 24 is provided by a toroidal coil 92 rather than an insulated gap 51. Except where otherwise noted here, the galvanic information transmission system 90 is constructed and operates in the same manner as the galvanic information transmission system 50 described earlier. The toroidal coil 92 is made up of a ring 94 which has a number of wraps of conductive wire 96 helically wrapping the surface of the ring 94, as illustrated in FIG. 11. When positioned between the casing 16 and the surface cement plug 24, the toroidal coil 92 presents an upper axial end 98 and a lower axial end 100. Energizing the conductive wire 96 will inject current into the surface cement plug 24 and surrounding earth 12. Circular current flowing in the wire 96 induces a magnetic field flowing in a straight line through the axis of the ring 94. So, while the magnetic field is induced in this instance, due to the shape of the filed induced, electric current is caused to flow through the surface cement plug 24 and surrounding earth 12 by conduction rather than induction. The ring 94 should have high magnetic permeability to aid the flow of magnetic field inside. For example, ferrite may be used. The toroidal coil 92 acts as the current injection electrode in this embodiment.

Exemplary information transmission systems in accordance with the present invention have been described with respect to land-based wells. They can, however, be used with subsea wells as well if a means for communication of information is provided that will relay that information to the surface of the sea. For example, a sonar device, of a type known in the art, could be interconnected with either the receiver coil 32 or current receiving electrode 54 described above and transmitted from the sonar device to a ship or sea-surface platform.

Those of skill in the art will understand that the invention provides systems and methods for communicating information across a surface cement plug 24 in a plugged off wellbore using electromagnetic signals. An exemplary communication system includes at least one sensor 36 for detecting at least one wellbore condition within a wellbore 10. A communication system in accordance with the present invention preferably includes an electromagnetic (EM) signal transmitter in the form of either an induction telemetry transmitter coil 30 or a current injection electrode 52. A communication system in accordance with the present invention also preferably includes an EM signal receiver in the form of either the induction telemetry receiver coil 32 or current receiving electrode 54. Exemplary communication systems also preferably include a mechanism for transmitting wellbore condition information which is detected by the sensor to the EM signal transmitter across a wellbore completion plug 20 which encloses the wellbore 10 below the surface cement plug 24.

The invention also provides methods for communicating wellbore condition information from within a wellbore that has been plugged off with a surface cement plug 24. In accordance with exemplary embodiments, information relating to at least one wellbore condition (i.e., pressure, temperature, etc.) is communicated from below the completion plug 20 to the upper side of the completion plug 20. The information is communicated across the surface cement plug 24 in the form of an electromagnetic signal. In described embodiments, the electromagnetic signal takes the form of an induction telemetry signal or a galvanic telemetry signal.

Those of skill in the art will recognize that numerous modifications and changes may be made to the exemplary designs and embodiments described herein and that the invention is limited only by the claims that follow and any equivalents thereof.

What is claimed is:

1. A system for transmitting information indicative of a wellbore condition across a surface cement plug in a plugged off wellbore, the surface cement plug having an axial length within the wellbore and having an upper axial end and a lower axial end, the system comprising:

an electromagnetic signal transmitter located within the wellbore proximate the lower axial end of the surface cement plug, the electromagnetic signal transmitter receiving information indicative of the wellbore condition and transmitting the information into the lower axial end of the surface cement plug as an electromagnetic wave signal which is transmitted through the surface cement plug via induction or galvanic telemetry; and an electromagnetic signal receiver located proximate the upper axial end of the surface cement plug to receive the electromagnetic wave signal from the upper axial end of the surface cement plug.

2. The system of claim 1 further comprising a wellbore condition sensor located within the wellbore to detect the wellbore condition and provide information indicative of the wellbore condition to the electromagnetic signal transmitter.

3. The system of claim 2 further comprising a controller that is operably interconnected with the wellbore condition sensor and electromagnetic signal transmitter, the controller receiving data from the wellbore condition sensor and encoding the data for transmission as an electromagnetic signal by the electromagnetic signal transmitter.

4. The system of claim 3 wherein the controller is disposed within a data sub within the plugged off wellbore.

5. The system of claim 3 further comprising a duplex transmission system which allows communication of an electromagnetic signal from the upper axial end of the surface cement plug to the lower axial end of the surface cement plug and having:

an electromagnetic signal transmitter located proximate the upper axial end of the surface cement plug to transmit the electromagnetic signal; and an electromagnetic signal receiver located within the wellbore proximate the lower axial end of the surface cement plug, the electromagnetic signal receiver further being operably interconnected with the controller to provide a command to the controller.

6. The system of claim 1 wherein:

the electromagnetic signal transmitter comprises an induction telemetry transmitter coil which induces a time-varying electric current signal in the surface cement plug and/or areas of earth surrounding the surface cement plug; and the electromagnetic signal receiver comprises an induction telemetry receiver coil to receive the electric current signal via electrical induction.

7. The system of claim 1 wherein:

the electromagnetic signal transmitter comprises a galvanic telemetry current generation arrangement which includes:

an current injector defined between the surface cement plug and a metallic casing within the wellbore, the current injector having an upper axial end and a lower axial end;

a first current injection electrode located proximate the lower axial end;

a second injection electrode located proximate the upper axial end from which an electrical current signal is flowed into the surface cement plug when an electrical potential is applied across the insulated gap; and the electromagnetic signal receiver comprises a galvanic telemetry receiver electrode.

8. The system of claim 7 wherein the current injector comprises an insulated gap.

9. The system of claim 7 wherein the current injector comprises a toroidal coil.

10. The system of claim 7 further comprising a surface cement plug that is at least partially comprised of a highly conductive cement.

11. The system of claim 1 further comprising:

a completion plug within the wellbore to close off the wellbore, the completion plug being located below the surface cement plug;

an exterior sensor disposed between the completion plug and the surface cement plug, the exterior sensor to detect leakage across the completion plug; and the exterior sensor being operably interconnected with the electromagnetic signal transmitter so that a signal representative of leakage can be transmitted by the electromagnetic signal transmitter.

12. The system of claim 1 wherein the wellbore condition comprises one from the group consisting of: pressure, temperature, presence of gas, oil, water, $CO_2$, $H_2S$, cement integrity, flow behind casing and casing condition.

13. A system for transmitting information indicative of a wellbore condition across a surface cement plug in a plugged off wellbore, the surface cement plug having an axial length within the wellbore and having an upper axial end and a lower axial end, the system comprising:

a wellbore condition sensor located within the wellbore to detect the wellbore condition and provide information indicative of the wellbore condition to an electromagnetic signal transmitter;

the electromagnetic signal transmitter located within the wellbore proximate the lower axial end of the surface cement plug, the electromagnetic signal transmitter receiving information indicative of the wellbore condition and transmitting the information into the lower axial end of the surface cement plug as an electromagnetic wave signal via induction or galvanic telemetry;

an electromagnetic signal receiver located proximate the upper axial end of the surface cement plug to receive the electromagnetic wave signal from the upper axial end of the surface cement plug.

14. The system of claim 13 wherein:

the electromagnetic signal transmitter comprises an induction telemetry transmitter coil which induces a time-varying electric current signal in the surface cement plug and/or areas of earth surrounding the surface cement plug; and the electromagnetic signal receiver comprises an induction telemetry receiver coil to receive the electric current signal via electrical induction.

15. The system of claim 13 wherein:

the electromagnetic signal transmitter comprises a galvanic telemetry current generation arrangement which includes:

a current injector defined between the surface cement plug and a metallic casing within the wellbore, the current injector having an upper axial end and a lower axial end;

a first current injection electrode located proximate the lower axial end;

a second injection electrode located proximate the upper axial end from which an electrical current signal is flowed into the surface cement plug when an electrical potential is applied across the current injector; and the electromagnetic signal receiver comprises a galvanic telemetry receiver electrode.

16. The system of claim 15 wherein the current injector comprises an insulated gap.

17. The system of claim 15 wherein the current injector comprises a toroidal coil.

18. The system of claim 13 further comprising:

a completion plug within the wellbore to close off the wellbore, the completion plug being located below the surface cement plug;

an exterior sensor disposed between the completion plug and the surface cement plug, the exterior sensor to detect leakage across the completion plug; and the exterior sensor being operably interconnected with the electromagnetic signal transmitter so that a signal representative of leakage can be transmitted by the electromagnetic signal transmitter.

19. The system of claim 13 further comprising a controller that is operably interconnected with the wellbore condition sensor and electromagnetic signal transmitter, the controller receiving data from the wellbore condition sensor and encoding the data for transmission as an electromagnetic signal by the electromagnetic signal transmitter.

20. A method of communicating wellbore condition information across a surface cement plug from within a wellbore that has been plugged off with the surface cement plug, the method comprising the steps of:

sensing at least one wellbore condition; and communicating the wellbore condition information into the lower axial end of the surface cement plug in the form of an electromagnetic wave signal via induction or galvanic telemetry which is received from the upper axial end of the surface cement plug.

21. The method of claim 20 wherein the step of communicating the wellbore condition information across the surface cement plug comprises:

energizing an induction telemetry transmitter coil which induces a time-varying electric current signal through the surface cement plug and/or areas of earth surrounding the surface cement plug; and receiving the electric current signal with an induction telemetry receiver coil.

22. The method of claim 20 wherein the step of communicating the wellbore condition information across the surface cement plug comprises:

energizing a galvanic current injection electrode to inject a time-varying electric current signal into the surface cement plug; and receiving the electric current signal with a galvanic telemetry receiver electrode.

* * * * *